United States Patent [19]

Beal

[11] 3,946,883

[45] Mar. 30, 1976

[54] METHOD FOR PALLETIZING

[75] Inventor: Ira W. Beal, Hudson, Ill.

[73] Assignee: Funk Seeds International, Inc., Bloomington, Ill.

[22] Filed: Sept. 10, 1973

[21] Appl. No.: 395,588

[52] U.S. Cl. ..... 214/152; 108/55; 214/10.5 R

[51] Int. Cl.[2] ..... B65G 1/16

[58] Field of Search ..... 214/10.5 R, 152, 621; 206/491, 492; 229/23 R; 108/51, 52, 56, 55

[56] References Cited

UNITED STATES PATENTS

| | | | |
|---|---|---|---|
| 2,896,798 | 7/1959 | Celley | 108/52 X |
| 3,043,450 | 7/1962 | Caprin et al. | 108/56 X |
| 3,229,836 | 1/1966 | Koenig | 214/514 X |

FOREIGN PATENTS OR APPLICATIONS

| | | | |
|---|---|---|---|
| 995,403 | 6/1965 | United Kingdom | 214/10.5 R |

*Primary Examiner*—Frank E. Werner
*Attorney, Agent, or Firm*—Fitch, Even, Tabin & Luedeka

[57] ABSTRACT

This invention relates to methods and apparatus for palletizing. The apparatus includes a flexible board blank which may be formed to provide a pallet having channels for insertion of the prongs of a fork lift truck. The pallet includes flaps which extend between stacked layers of bags to reinforce the load and pallet structure. The apparatus further includes an open sided box which may be utilized to form the blank into a pallet and permit ready stacking of units, such as deformable bags of seed, on the pallet. The method concerns the forming of the pallet from the blank and stacking of the units on the pallet.

2 Claims, 8 Drawing Figures

METHOD FOR PALLETIZING

The present invention relates generally to method and apparatus for palletizing packaged products, and more particularly, it relates to method and apparatus for palletizing deformable products, such as bags of seed.

In the materials handling field, it is, of course, well known to palletize packaged products for storage and convenient movement and handling by means of fork trucks or the like. Many pallet constructions are known and, generally, they are of a rigid construction being made of wood, and occasionally of metal. However, expendable pallets are known and are advantageous in order to overcome the problem of returning the pallets. Such expendable pallets have been made of paperboard, such as disclosed in U.S. Letters Pat. No. 2,913,206 and No. 3,043,450. Due to the inherent flexibility of paperboard, the handling of heavy loads has been a problem and this problem becomes more difficult when the load is made up of bags of flowable material, such as seed bags. The deformability of such bags containing flowable material and the inherent flexibility of paperboard creates a difficult materials handling problem while the desirability for an economical and expendable pallet remains.

Accordingly, it is a main object of this invention to provide an improved materials handling system by means of a novel method and apparatus for palletizing packaged products. A further object of this invention is the provision of an improved method and apparatus for handling bagged flowable materials, such as seed bags. A further object of the invention is the provision of apparatus for handling heavy loads of bagged flowable materials including a pallet, which pallet is expendable and which is readily stacked in condensed form. Another object of this invention is the provision of improved means for readily stacking bagged flowable materials on a paperboard pallet which can then be readily picked up and transported.

Further objects and advantages of this invention will become apparent by reference to the following drawings and description.

Figure 1:
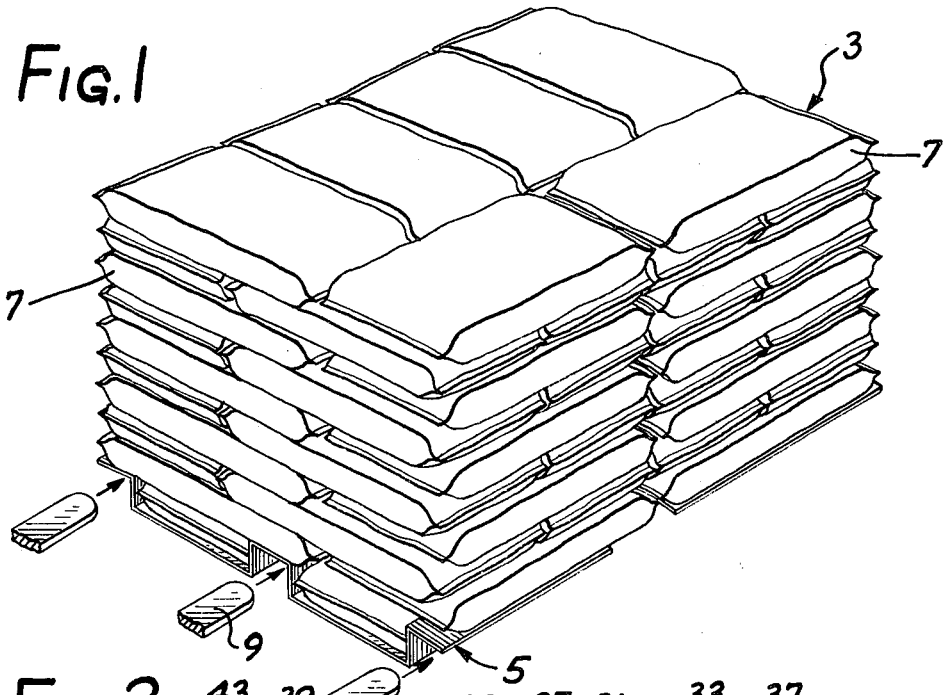
FIG. 1 is a perspective view of a palletized load of bags of seed on a pallet made in accordance with this invention showing the forward ends of prongs of a fork truck in position to enter the pallet.

Referring now to the drawings, FIG. 1 shows a palletized load 3 comprising a pallet 5 on which is stacked a plurality of flexible bags 7 of flowable material. The pallet 5 is proportioned to accommodate prongs 9 on a fork lift truck (not shown). The manner of stacking the bags 7 and the particular location of the bags relative to the pallet 5 will be hereinafter pointed out. The invention is particularly adapted for flexible bags of cloth or plastic which contain flowable materials, such as seed, grain, granulated sugar, or the like. These bags have been quite difficult to handle and there has been a problem in stacking them, particularly upon collapsible pallets which could be transported.

Figure 2:
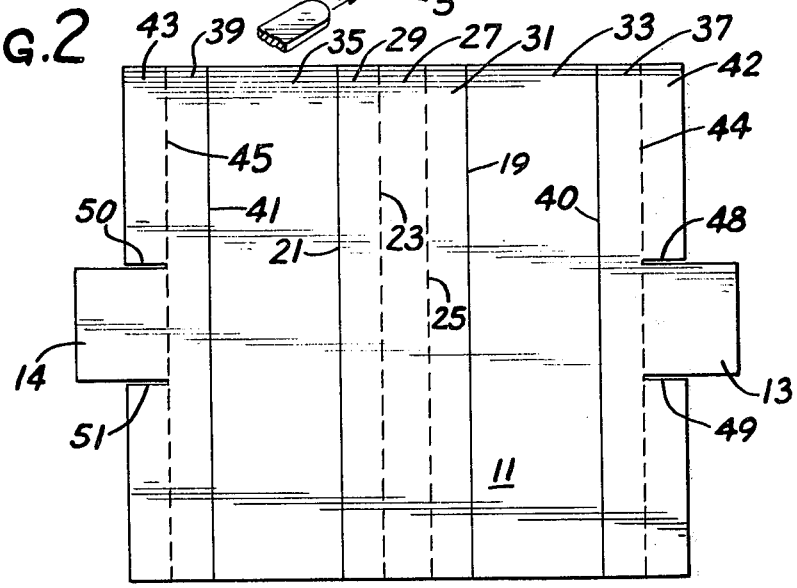
FIG. 2 is a plan view of a blank made in accordance with this invention.

The pallet 5 is made up from a blank 11 which is shown in plan view in FIG. 2. The blank 11 is cut out from a foldable material, such as paperboard, including corrugated board, or possibly a thin metal. The blank 11 is preferably cut out from paperboard and may be in the form which is shown in FIG. 2. The blank 11 includes a pair of outwardly and oppositely extending flaps 13 and 14 which are a part of the blank 11 and provide an important feature for the pallet 5. Other than the flaps 13 and 14, the blank 11 is generally rectangular in shape and is scored to facilitate folding into the pallet 5, which is shown set up in FIG. 3.

The set up pallet 5 provides a central channel 15 and a pair of outward channels 16 and 17 positioned to receive the prongs 9 of a fork lift truck. In order to define these channels 15, 16 and 17, the score lines are provided in the blank 11. In this connection, the central channel 15 is formed by the provision of score lines 19 and 21 with reverse score lines 23 and 25 located inwardly of the score lines 19 and 21. The reverse score lines 23 and 25 define a flat section 27 which connects along its edges to downwardly extending sections 29 and 31. The downwardly extending sections 29 and 31 connect to bottom sections 33 and 35 which, as will be hereinafter pointed out, support bags 7 of flowable material and in so doing contribute to the overall structure of the pallet 5.

The channels 16 and 17 are defined in part by upwardly extending sections 37 and 39, respectively, which connect to the bottom sections 33 and 35 along score lines 40 and 41, respectively. The upper edges of the sections 37 and 39 connect to wings 42 and 43 along reverse score lines 44 and 45, respectively, to further define the channels 16 and 17.

Figure 3:
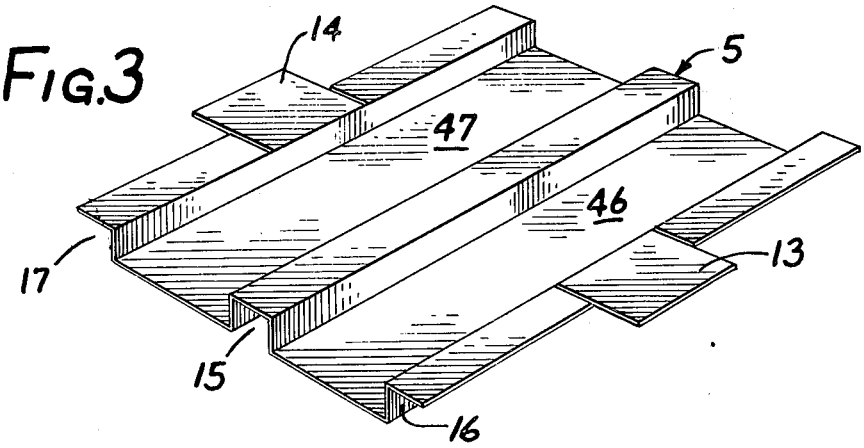
FIG. 3 is a view of the blank shown set up for receiving the bags of seed.

The upwardly extending sections 31 and 37, with the bottom section 33, as well as the upwardly extending sections 29 and 39, with the bottom section 35 define bag receiving troughs 46 and 47, as particularly shown in FIGS. 1 and 3. The upwardly extending sections 37 and 39 each define a side of the channels 16 and 17 and connect to the wings 42 and 43 which define the top of the channels 16 and 17. As will be seen in FIG. 1, the flat section 27 and wings 42 and 43 support the bags 7.

Figure 4:
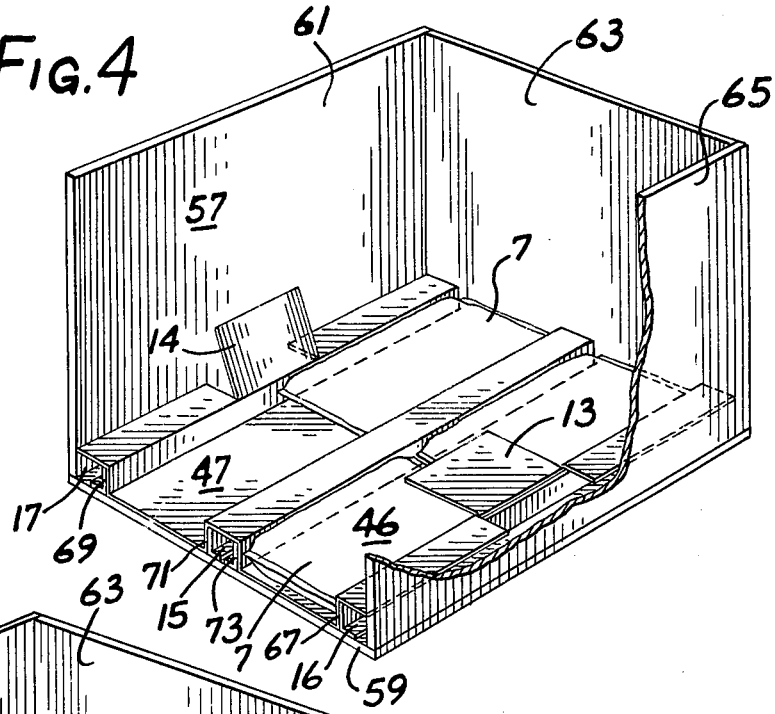
FIG. 4 is a perspective view, partially broken away, showing a novel box for forming and receiving the set up pallet shown in FIG. 3.

The flaps 13 and 14 are an important feature of the blank 11 and pallet 5 in providing proper load support. The flaps are connected along the score lines 44 and 45, respectively, and are proportioned to fold over the troughs 46 and 47 and to fold between stacked bags 7 so as to trap and hold the outer ends of the flaps within the load. Slits 48 and 49 are provided in the wing 42 and slits 50 and 51 are likewise provided in the wing 43 so that the flaps 13 and 14 fold out of the plane of the wings 42 and 43 and are disposed between stacked bags 7. This provides stability and load support which has not been heretofore provided by existing pallet systems. This unique feature of the pallet 5 particularly provides for the stacking of the bags of flowable material and the trapping of the flaps into the load reinforces the pallet 5 in such manner as to give a pallet of increased support. When the bags 7 are loaded into the troughs 46 and 47 of the pallet 5, the flaps 13 and 14 are folded upwardly along score lines 44 and 45 (FIG. 4) and over the bags in the troughs and a subsequent layer of bags trap these flaps 13 and 14 into the load.

Figure 7:
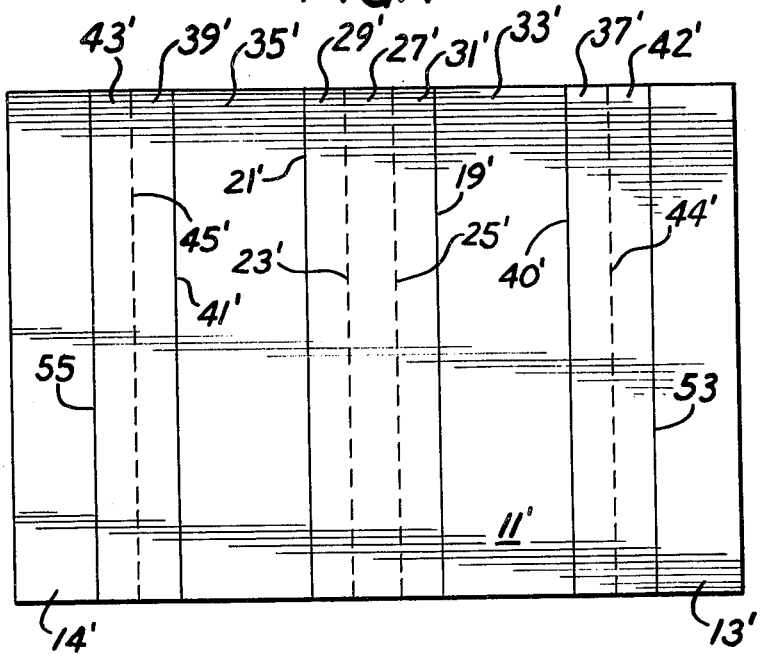
FIG. 7 is a view similar to FIG. 2 showing another blank in accordance with this invention.
Figure 8:
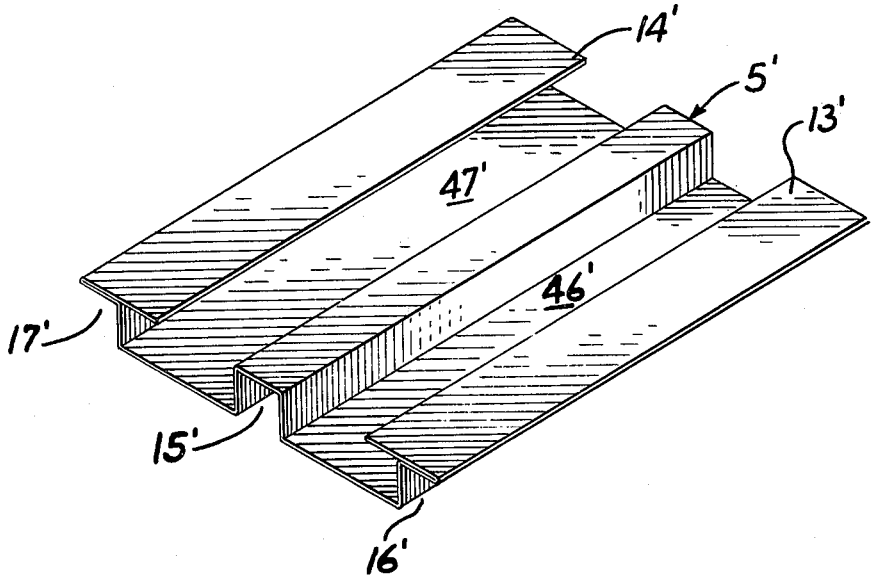
FIG. 8 is a view similar to FIG. 3 showing the blank in FIG. 7 set up.

Another form of blank and of pallet of the invention are shown in FIGS. 7 and 8. This form of pallet provides unusual capability for fork lift trucks of standard or conventional design. Since many parts of the blank and pallet shown in FIGS. 7 and 8 correspond to parts of the blank and pallet shown in FIGS. 2 and 3, corresponding parts will be similarly numbered but will be differentiated by the symbol prime (').

In the pallet 5' shown in FIG. 8, the flaps 13' and 14' desirably extend the full length of the pallet rather than being formed from a part of the wings 42' and 43'. The flaps 13' and 14' fold along score lines 53 and 55, respectively, over the wings 42' and 43' to extend over the troughs 46' and 47'. The score lines 53 and 55 correspond to the outer edges of the pallet 5'. As in the case of the flaps 13 and 14, the flaps 13' and 14' are trapped between layers of bags 7. However, since the flaps 13' and 14' are connected along the outer edges of the wings 42' and 43' and greater surface is disposed between the bags, a more stable pallet 5' is provided which can be more easily handled by conventional fork lift trucks.

If material savings are necessary, the flaps 13' and 14' need not extend the full length of the pallet 5' but more than one flap may then be provided along the outer edges of the wings 42' and 43'. In addition, tuck flaps (not shown) may extend outwardly of the flaps 13' and 14' or flaps 13 and 14 which may tuck into the associated troughs 46' and 47' or troughs 46 and 47.

It will be apparent that it is difficult to load the pallets 5 and 5' because of the flexibility of the blank 11 and particularly because of the deformability of the bags 7. Accordingly, a box 57 has been invented. The box 57 is particularly shown in FIGS. 4 and 5 and has an open top and one open side. The box 57 comprises a bottom 59 and upstanding sides 61, 63 and 65. The bottom 59 is provided with a series of angle irons, attached thereto, which define the channels 15, 16 and 17 for receiving the prongs 9 of a fork lift truck. The outer channels 16 and 17 are formed by angle irons 67 and 69 attached to the bottom 59 of the box. They are proportioned and positioned to accommodate the upstanding sides 37 and 39 of the blank 11. The central channel 15 is defined by a pair of spaced angle irons 71 and 73 which are positioned and proportioned to form the central channel 15 and accommodate the upstanding sides 29 and 31 and the flat section 27. Thus, the angle irons 67, 69, 71 and 73 form open topped channels so that the prongs 9 can lift the pallet 5 or 5' out of the box 57. The sides 61, 63 and 65 of the box 57 confine the bags 7 during stacking so as to facilitate the piling of the bags.

Figure 5:
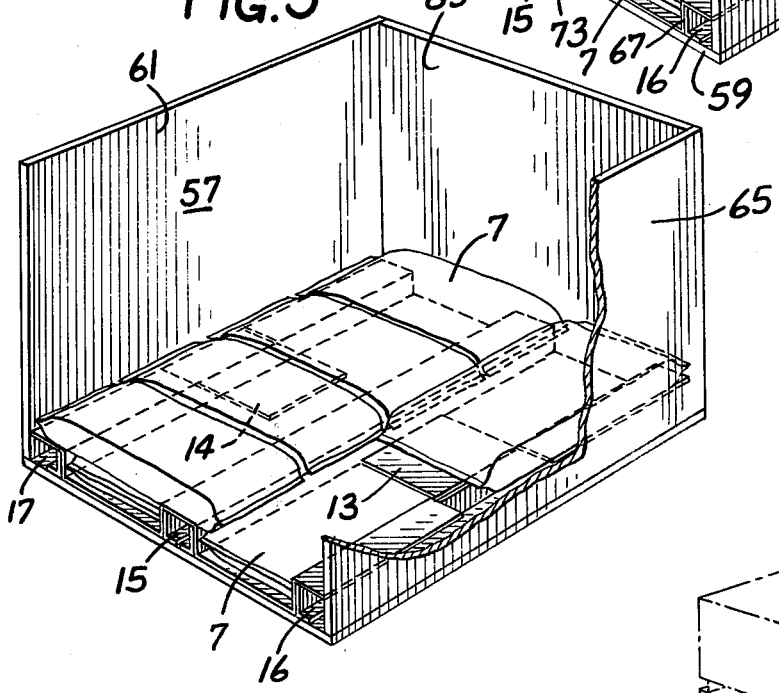
FIG. 5 is a view similar to FIG. 4 showing the manner of stacking of seed bags upon the pallet shown in FIG. 3.

The blank 11 or 11' is fitted into the box 57 to form the set up pallet shown in FIG. 3 or FIG. 8. Bags 7 are first loaded into the troughs 46 and 47. The bags 7 should fill these troughs thus providing added support and causing the bottommost bags to become a part of the pallet structure. The flaps 13 and 14 are then folded over the bags 7 in the troughs 46 and 47 as shown by dotted lines in FIG. 5. A first layer of bags 7 is then loaded onto a pallet 5 across the flat section 27 and wings 42 and 43. The flaps 13 and 14 are thus trapped between bags 7 (FIG. 5). Further layers are stacked in the box 57 thereby further locking the flaps. The bags may be criss-crossed in stacking (FIG. 1).

After the bags 7 are stacked onto the pallet 5 in the box 57 to the desired height, the prongs 9 of the fork lift truck are inserted into the channels 15, 16 and 17 (FIG. 1) and the palletized load 3 is lifted from the box 57 which is then ready to receive another blank 11. The box 57 permits rapid stacking of bags 7, if desired, but if there is intermittent availability of bags 7, the box provides a convenient receptacle for bags as they are received. The provision of the box 57 permits unskilled persons to stack the loads.

Figure 6:
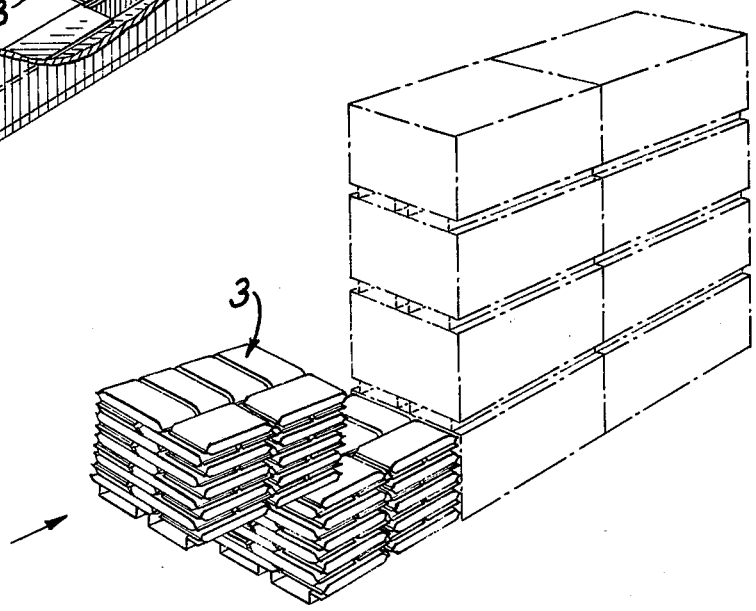
FIG. 6 is a perspective view showing the manner of stacking of the loaded pallets for storage purposes.

As shown in FIG. 6, the palletized loads 3 can be then stacked upon one another and the pallets 5 or 5' provide intervening support in the stacks. This permits high volume stacking of the bags 7 for storage purposes. It is readily apparent that upon unloading of the pallets 5 and 5' they can be readily condensed by flattening them out and stacking them.

The various features of the invention which are believed to be new are set forth in the following claims.

I claim:

1. A method of palletizing a plurality of flexible bags containing flowable material on an expendable pallet and into a unitized load for handling by a fork lift truck and for stacking, comprising the steps of forming a flexible blank into a pallet having (a) sections defining a central channel, (b) a trough on either side of said central channel extending parallel thereto, (c) wings extending outwardly from the troughs, and (d) flaps also extending outwardly from the wings wherein the pallet is set up on the bottom of an open sided box, forming the central channel and forming the troughs in the bottom of the box, filling the troughs with the bags, folding the flaps over bags in the troughs, and stacking additional bags over the flaps, whereby said pallet and said bags become interlocked to form a unitized load for handling by a fork lift truck.

2. A method in accord with claim 1 which includes provision of a box having angle irons on the bottom thereof positioned at opposite sides of the trough, and defining the central channel.

* * * * *